United States Patent [19]

Oikawa

[11] Patent Number: 5,017,968

[45] Date of Patent: May 21, 1991

[54] LIQUID DEVELOPMENT APPARATUS HAVING COMB-LIKE ELECTRODE

[75] Inventor: Shinro Oikawa, Tokyo, Japan

[73] Assignee: NEC Corporation, Tokyo, Japan

[21] Appl. No.: 439,310

[22] Filed: Nov. 21, 1989

[30] Foreign Application Priority Data

Nov. 21, 1988 [JP] Japan ..... 63-295033

[51] Int. Cl.[5] ..... G03G 15/06

[52] U.S. Cl. ..... 355/262; 118/660; 355/256

[58] Field of Search ..... 355/256, 258, 261, 262; 118/659, 660; 354/317, 324

[56] References Cited

U.S. PATENT DOCUMENTS

| | | | |
|---|---|---|---|
| 3,741,643 | 6/1973 | Smith et al. | 355/256 |
| 3,752,119 | 8/1973 | Matkan | 355/259 X |
| 3,973,955 | 8/1976 | Ohno et al. | 355/256 X |
| 4,157,219 | 6/1979 | Ohta et al. | 355/256 |
| 4,270,485 | 6/1981 | Murasawa et al. | 118/660 X |
| 4,368,669 | 1/1983 | Love, III | 355/256 X |
| 4,398,818 | 8/1983 | Jeromin et al. | 355/256 |

*Primary Examiner*—A. T. Grimley

*Assistant Examiner*—Nestor R. Ramirez

*Attorney, Agent, or Firm*—Sughrue, Mion, Zinn Macpeak & Seas

[57] ABSTRACT

An electrostatically charged image is applied to a smooth photoconductor surface and moved past a development station having an outer liquid chamber and an inner liquid chamber disposed therein. The outer and inner liquid chambers respectively communicate to outer and inner slits which are aligned with each other in a direction toward the photoconductor surface. In the slit of the inner housing is disposed a comb-like electrode which is biased at a potential opposite to the charged image. The comb elements of the electrode are successively arranged along an inner wall of the inner slit. Developing liquid is supplied to the inner chamber through an inlet port located below the inner slit so that the liquid overflows through the inner slit into the outer chamber while constantly wetting the outer slit to present a liquid surface to the electrostatically charged image. Baffle plates are secured to the inner walls of the inner chamber so that the developing liquid flows uniformly at all locations of the comb-like electrode toward the inner slit.

8 Claims, 4 Drawing Sheets

LIQUID DEVELOPMENT APPARATUS HAVING COMB-LIKE ELECTRODE

RELATED APPLICATION

This application is related to Co-pending U.S. patent application Ser. No. 07/324,863 of Uematsu et al., titled "Liquid development apparatus with perforated liquid carrier sheet", filed Mar. 17, 1989, and assigned to the same assignee as the present invention.

BACKGROUND OF THE INVENTION

The present invention relates to an apparatus for developing latent electrostatic images.

Developing a latent electrostatic image for so-called "office copier" machines involves the steps of uniformly charging a photoconductor surface, exposing it to an imagewise radiation and developing the exposed surface by depositing colored particles on the latent images. Shortcomings of this dry developer are that the colored particles cause dust that stains delicate parts of the copying machine and that the deposited particles must be fixed by applying heat and pressure. Another system that has been proposed to overcome these shortcomings is one that employs an organic developing liquid of high electrical resistivity in which colored particles are dispersed. A recording medium carrying latent electrostatic images is submerged into the liquid. Development of liquid occurs when the colored particles are deposited on the latent images through what is known as "electrophoretic" process which is followed by drying the organic liquid. One shortcoming of this type of development is the deposition of colored particles in the background where no such deposits should be present. In addition, the drying process tends to warm the organic liquid, causing it to evaporate. To solve these problems, U.S. Pat. No. 4,202,620 discloses a liquid development apparatus in which a film of developing liquid is formed on the surface of a roller submerged in the liquid and moved past a latent electrostatic image that is formed on a photoconductor surface. As the film is brought close to the latent image, electrostatic fields develop and the liquid bulges by attraction from its surface and adheres to the charged image. Since the disclosed apparatus allows the use of water-soluble developing liquid, the drying process does not result in the vaporization of organic solvent.

However, one shortcoming of the aforesaid U.S. Patent resides in the fact that field concentrations can occur in localized areas of a relatively wide, high density (colored) area, resulting in nonuniform distribution of field intensities, and hence "white blots" in an otherwise uniformly colored area. Furthermore, the localized field concentration causes clustering of small liquid bulges into a single lump, and hence a loss of fine details.

SUMMARY OF THE INVENTION

It is therefore an object of the present invention to provide a liquid development apparatus which permits the reproduction of uniformly colored area and fine details.

According to a broader aspect of the present invention, there is provided an apparatus for developing a latent electrostatic image. The apparatus comprises a member having a smooth surface capable of having an electrostatically charged image applied thereto and capable of being driven so that the charged image moves past a development zone. A liquid housing is provided having a slit located in the development zone, an inlet port and a liquid chamber defined between the inlet port and the slit. In the slit is secured a comb-like electrode having a plurality of electrode elements which are successively arranged along the length of the slit and biased at a potential opposite to the potential of the charged image. Means are provided for constantly supplying developing liquid under pressure into the liquid chamber through the inlet port of the housing so that the slit is constantly wet with the developing liquid to form a meniscus in the development zone. The comb-like electrode has the effect of dividing the meniscus into a multitude of portions of high field intensity. By virtue of the comb-like electrode, reproduction of uniformly colored areas and fine details can be achieved. In addition, the constant flow of pressurized developing liquid towards the slit prevents shortage of fluid supply which would otherwise cause deformation of meniscus.

Preferably, the liquid chamber is formed with a plurality of baffle members arranged in the liquid chamber so that the developing liquid flows at a constant rate toward the opening of the slit.

According to a specific aspect, the present invention provides a liquid development apparatus in which the housing is formed with an inlet port, an inner slit and an inner liquid chamber which communicates the inlet port to the inner slit. An outer slit is located in the development zone and spaced from and aligned with the inner slit. An outer liquid chamber is formed to communicate the inner slit to the outer slit and to an outlet port through which the liquid overflowed through the inner slit is drained for circulation. Developing liquid is constantly supplied under pressure through the inlet port of the housing into the inner liquid chamber so that the supplied liquid overflows through the inner slit into the outer liquid chamber and is drained through the outlet port, while constantly wetting the outer slit to form a meniscus in the development zone. The inner liquid chamber is preferably formed with a plurality of baffle members arranged so that the developing liquid flows at a constant rate in a direction toward the inner slit.

BRIEF DESCRIPTION OF THE DRAWINGS

The present invention will be described in further detail with reference to the accompanying drawings, in which.

DETAILED DESCRIPTION

Figure 1:
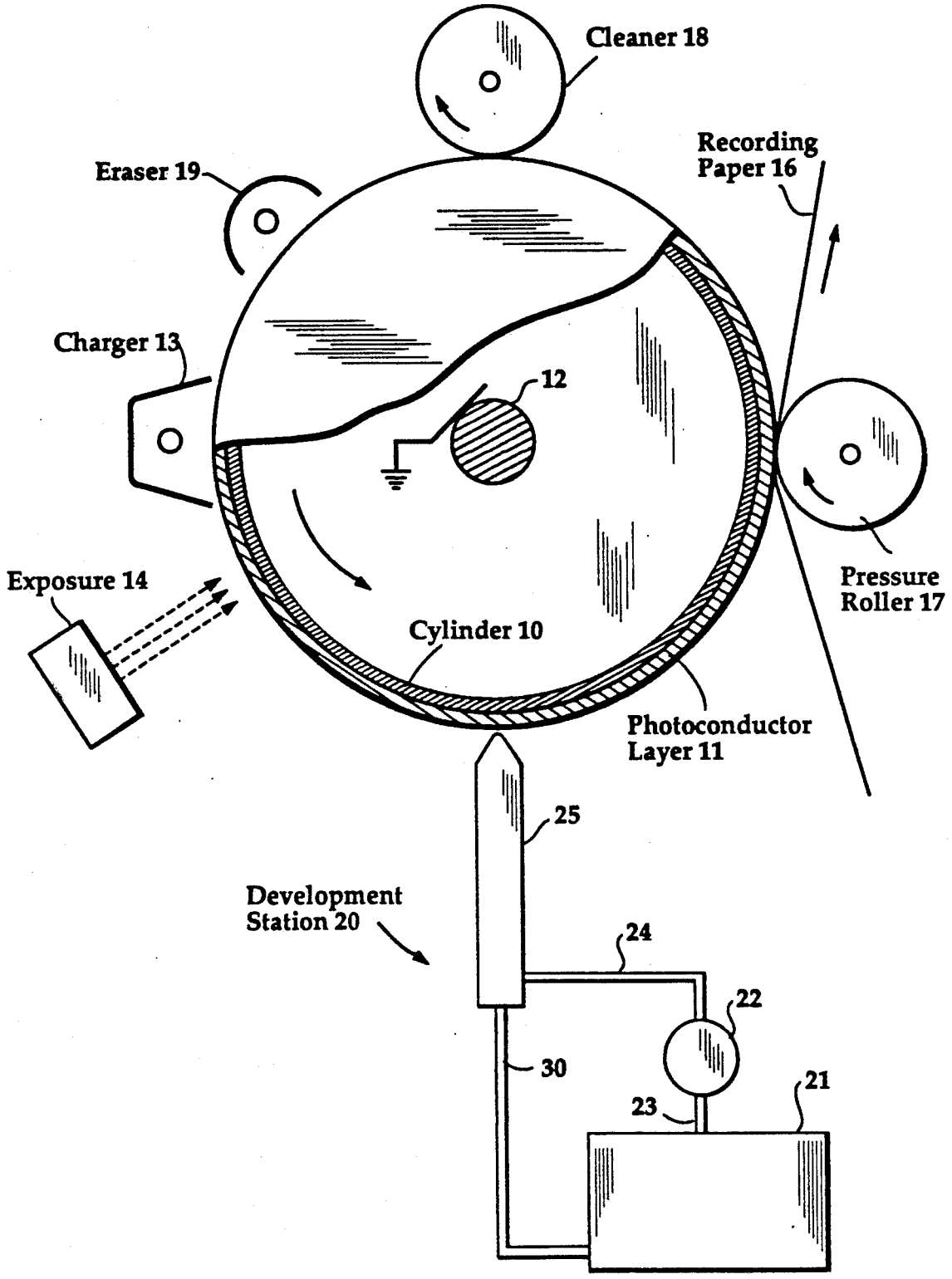
FIG. 1 is a view of a liquid development apparatus according to an embodiment of the present invention.

Referring now to FIG. 1, there is shown a liquid development apparatus for latent electrostatic images according to an embodiment of the present invention. The apparatus includes a cylinder 10 with a photoconductor layer 11 having a smooth surface and suitable means, not shown, to rotate the cylinder. The cylinder 10 is closed at the opposite ends by end plates which are secured to a rotary shaft 12 which is grounded. The function of the photoconductor cylinder 10 is to create latent electrostatic images on the photoconductor layer 11 as it turns counterclockwise about shaft 12 past a charging station 13 and an exposure station 14, cause the latent images to be developed by a development station 20 and to transfer the developed images to a web, or recording sheet 16 by contact with a pressure roller 17. Photoconductor cylinder 10 further rotates past a cleaning station 18 and an erasure station 19 to remove residual development material and residual electrostatic charges.

Figure 2:
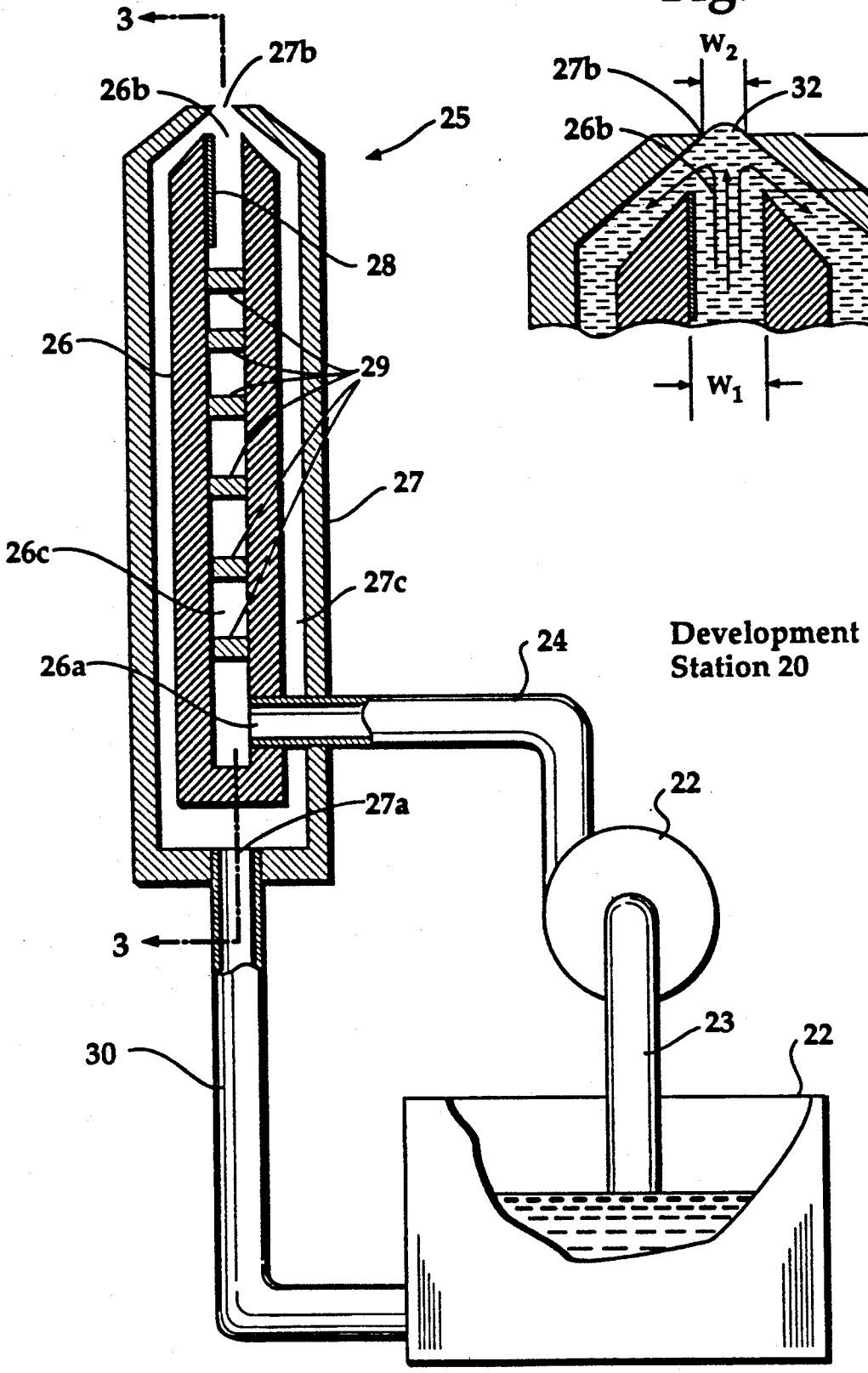
FIG. 2 is a view of the development station of FIG. 1, with the liquid housing being cut in transversal cross-section to reveal the inside.
Figure 3:
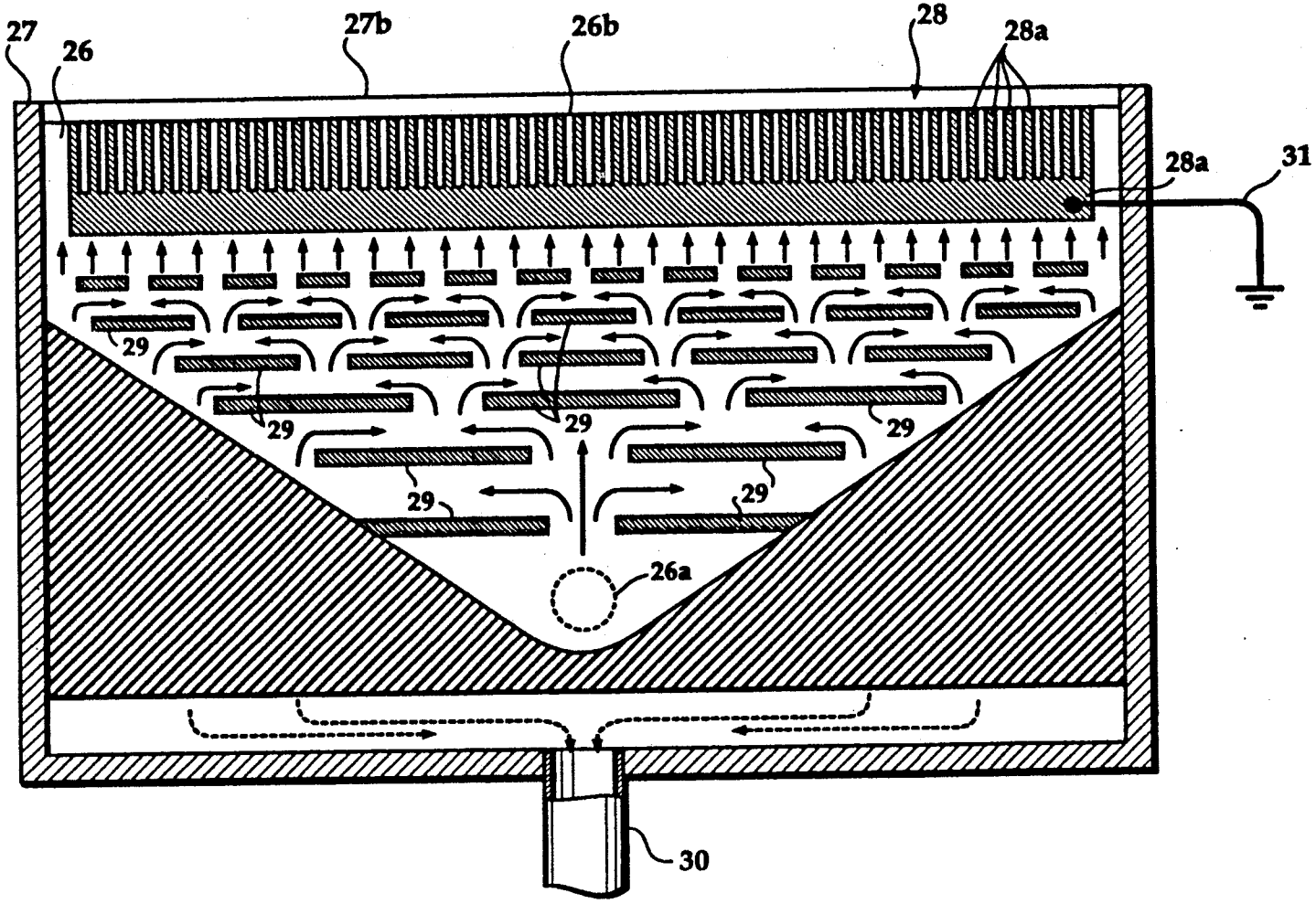
FIG. 3 is a longitudinal cross-sectional view of the liquid housing taken along the lines 3—3 of FIG. 2.

As shown in FIGS. 2 and 3, the development station 20 generally comprises a liquid container 21 for holding development liquid. A pump 22 sucks in liquid from container 21 through a pipe 23, compresses it and provides pressurized development liquid through a pipe 24 to a housing 25. Housing 25 comprises an inner member 26 and an outer member 27 in which the inner member is suitably disposed. Inner member 26 is formed with an inlet port **26*a* to which the pipe 24 from pump 22 is terminated, an elongated slit 26*b* on top of it and a liquid chamber 26*c* which communicates the inlet port 26*a* to the slit 26*b*. Outer member 27 is formed with an outlet port 27*a* with is aligned with the inner slit 26*b*, an elongated slit 27*b* and a liquid chamber 27*c* which is defined between the inner walls of the outer member 27 and the outer walls of the inner member 26. The outer liquid chamber 27*c* communicates the inner slit 26*b* to the outlet port 27*a*, while opening to the outside through the outer slit 27*b* so that the latter is constantly wet with developing liquid overflowed through the inner slit 26*b*. The outlet port 27*a* is connected by a pipe 30 to the liquid container 21** to circulate the liquid.

Along an upper edge of the inner slit **26*b* is secured a comb-like electrode 28. As clearly shown in FIG. 3, the electrode 28 has a multitude of comb elements 28*a* which are successively arranged along the length of the inner slit 26*b* and a web portion 28*b* which is suitably connected to ground as at 31** to charge the liquid at a potential opposite to the potential of the charged image.

In the liquid chamber **26*c* is provided a plurality of spaced apart baffle plates 29 of different lengths. A smaller number of baffle plates 29 of longer length are located adjacent the inlet port 26*a* and spaced apart at longer distances, and a larger number of baffle plates 29 of shorter length are located adjacent the slit 26*b* and spaced apart at shorter distances. These baffle plates are arranged so that pressurized developing liquid supplied through the inlet port 26*a* finds an increasing number of passages as it flows towards the slit 26*b* and uniformly flows at a constant rate at all locations of the comb-like electrode 28 as indicated by solid-line arrows. Under the pressure exerted by pump 22, the liquid in the inner chamber 26*c* overflows through the inner slit 26*b* into the outer chamber 27*c* and is drained through the outlet port 27*a* to the container 21 as indicated by dotted-line arrows. The liquid overflowed through the inner slit 26*b* wets the edges of the outer slit 27*b* and bulge outward from the opening of the slit 27*b*, forming a uniformly charged meniscus adjacent the photoconductor surface as indicated at 32 in FIG. 4. The height of the meniscus can be varied by the width of the outer slit 27*b*** as well as by the rate of liquid flow in accordance with a desired image resolution.

Figure 5A:
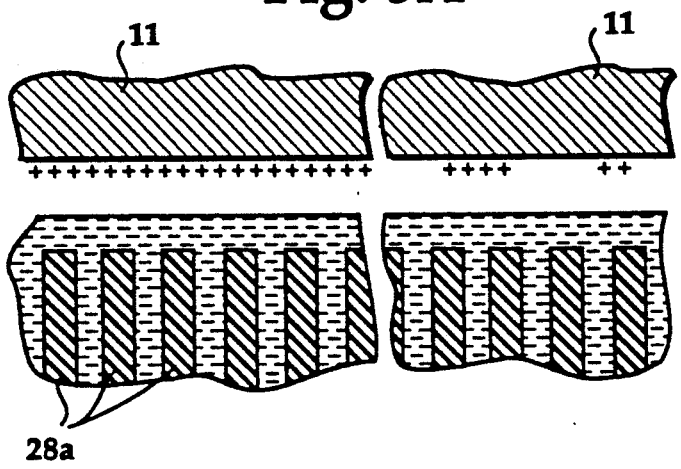
FIGS. 5A to 5C show processes of liquid development according to the present invention.
Figure 5B:
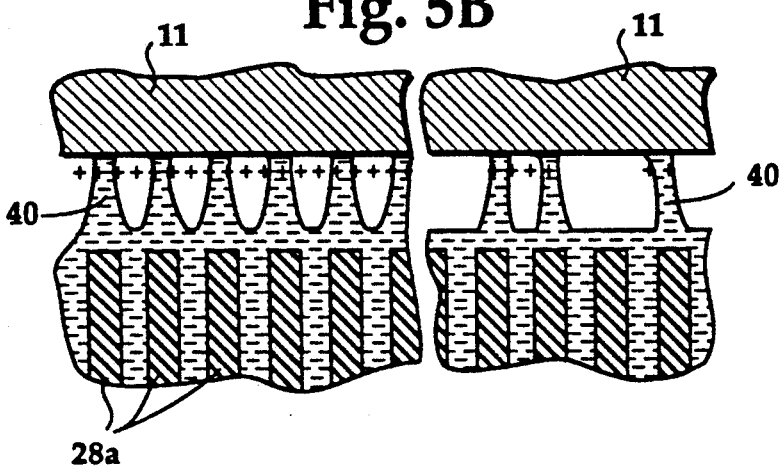
Figure 5C:
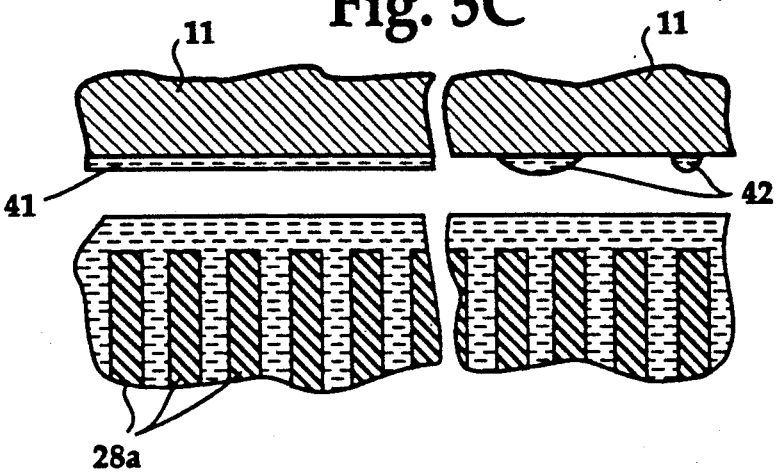

As latent images on the photoconductor layer 11 approach the meniscus thus created along the outer slit **27*b* (FIG. 5A), the field intensities in the space therebetween increase and portions of the meniscus corresponding to the comb elements 28*a* bulge and columns of liquid as show at 40 rise to the photoconductor surface 15 (FIG. 5B) and are torn apart from the meniscus to form a nonbreaking layer of liquid 41 on a uniformly charged area of the photoconductor surface 11 and islands of liquid 42 on an area where the image is not uniform (FIG. 5C). By virtue of the comb-like electrode 28, high field concentrations occur in portions of the meniscus 32 where the comb elements of the electrode 28** exist. Therefore, the meniscus can be divided into a multitude of portions of equal field intensity if they are intensified by a large uniformly charged image.

When liquid discharge occurs, if there is no constant flow of liquid, portions of the meniscus would tend to retract somewhat from the opening of the outer slit **27*b* to the extent that tip portions of the comb-like electrode 28 are exposed to the air. Since the outer slit 27*b* is wet with the liquid overflowed through the inner slit 26*b* by virtue of the constant flow of liquid along the elements of the comb-like electrode 28, the meniscus substantially retains its original shape. If tip portions of the electrode 28** are otherwise exposed to the air, arcing would occur due to field intensity which might reach as high as 10 megavolts/meter, causing deleterious effects on the operation of the liquid development apparatus.

Figure 4:
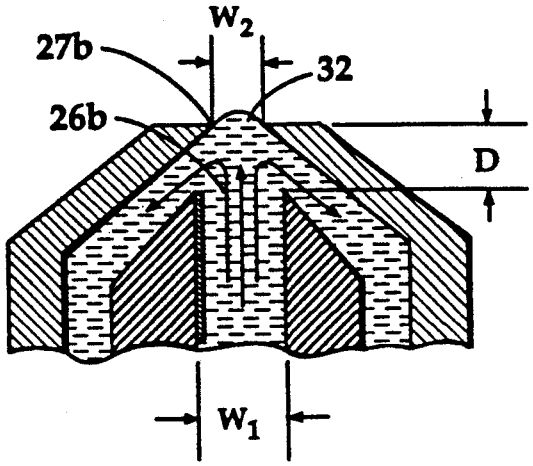
FIG. 4 is an enlarged transversal cross-sectional view of an end portion of the liquid housing to illustrate a meniscus formed in the outer slit.

As shown in FIG. 4, the inner slit **26*b* has a width $W_1$ which can be in a range between 50 μm and 3000 μm, and the outer slit 27*b* has a width $W_2$ in a range between 50 μm and 1000 μm. The distance D between the openings of slits 26*b* and 27*b* is in a range between 50 μm and 5000 μm. In a preferred embodiment, width $W_1$ is larger than width $W_2$, with $W_1$ being in the range between 100 μm and 500 μm and $W_2$ being in the range between 50 μm and 200 μm. The preferred value of distance D is in the range between 50 μm and 300 μm. Pump 22 is operated so that the flow rate of developing liquid in the inner chamber 26*c*** is preferably in the range between 0.2 and 50 $mm^3$/(second × meter).

The foregoing description shows only one preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. An apparatus for developing a latent electrostatic image, comprising:

a member having a smooth surface capable of having an electrostatically charged image applied thereto and capable of being driven so that said charged image moves past a development zone;

means for applying a latent electrostatically charged image to said surface of said member;

housing means for forming an inlet port, an inner slit, an inner liquid chamber communicating said inlet port to said inner slit, an outer slit located in said development zone and spaced from and aligned with said inner slit, an outlet port, and an outer liquid chamber communicating said inner slit to said outer slit and to said outlet port;

a comb-like electrode having a plurality of elements secured on a side wall of said inner liquid chamber, said elements being successively arranged along the length of said inner slit and biased at a potential opposite to the potential of said charged image; and means for supplying developing liquid under pressure into said inner liquid chamber so that the supplied liquid overflows through said inner slit into said outer liquid chamber and constantly wets said outer slit to form a meniscus adjacent said charged image.

2. An apparatus as claimed in claim 1, wherein said housing means further comprises a plurality of spaced apart baffle members arranged in said inner liquid chamber so that the developing liquid flows uniformly at all locations of said electrode.

3. An apparatus for developing a latent electrostatic image, comprising:

a member having a smooth surface capable of having an electrostatically charged image applied thereto and capable of being driven so that said charged image moves past a development zone;

means for applying a latent electrostatically charged image to said surface of said member;

housing means for forming an inlet port, an inner slit, an inner liquid chamber communicating said inlet port to said inner slit, an outer slit located in said development zone and spaced from and aligned with said inner slit, an outlet port, and an outer liquid chamber communicating said inner slit to said outer slit and to said outlet port, said inner slit having a width larger than the width of said outer slit;

a comb-like electrode having a plurality of elements successively arranged along the length of said inner slit and biased at a potential opposite to the potential of said charged image; and means for supplying developing liquid under pressure into said inner liquid chamber so that the supplied liquid overflows through said inner slit into said outer liquid chamber and constantly wets said outer slit to form a meniscus adjacent said charged image.

4. An apparatus as claimed in claim 3, wherein said housing means further comprises a plurality of spaced apart baffle members arranged in said inner liquid chamber.

5. An apparatus as claimed in claim 3, wherein said inner slit has a width in the range between 100 μm and 500 μm and said outer slit has a width in the range between 50 μm and 200 μm.

6. An apparatus as claimed in claim 5, wherein said inner and outer slits are spaced apart a distance in the range between 50 μm and 300 μm.

7. An apparatus as claimed in claim 5, wherein the development liquid in said inner liquid chamber flows at a rate in the range between 0.2 and 50 $mm^3/(second \times meter)$.

8. An apparatus as claimed in claim 6, wherein the development liquid in said inner liquid chamber flows at a rate in the range between 0.2 and 50 $mm^3/(second \times meter)$.

* * * * *